US006886912B2

(12) United States Patent
Mantell

(10) Patent No.: US 6,886,912 B2
(45) Date of Patent: May 3, 2005

(54) METHOD AND APPARATUS FOR PROCESSING IMAGES HAVING COLOR COMBINATIONS

(75) Inventor: David A. Mantell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 84 days.

(21) Appl. No.: 10/342,604

(22) Filed: Jan. 15, 2003

(65) Prior Publication Data

US 2004/0135845 A1 Jul. 15, 2004

(51) Int. Cl.[7] ..... B41J 2/21
(52) U.S. Cl. ..... 347/43; 347/15
(58) Field of Search ..... 347/43, 15, 14, 347/16, 37; 358/1.2, 1.9

(56) References Cited

U.S. PATENT DOCUMENTS 5,635,967 A 6/1997 Klassen ..... 347/43
5,717,448 A * 2/1998 Inada ..... 347/43
6,123,411 A * 9/2000 Inui et al. ..... 347/43
6,161,919 A 12/2000 Klassen ..... 347/43
6,183,062 B1 2/2001 Curtis et al. ..... 347/41
6,290,330 B1 9/2001 Torpey et al. ..... 347/43
6,343,847 B1 2/2002 Torpey et al. ..... 347/15

FOREIGN PATENT DOCUMENTS

EP 1 107 577 A2 6/2001

* cited by examiner

*Primary Examiner*—Lamson D Nguyen
(74) *Attorney, Agent, or Firm*—Fay, Sharpe, Fagan, Minnich & McKee, LLP

(57) ABSTRACT

This invention relates to a method and apparatus for processing images having color combinations. Such combinations may be embodied in, for example, a black object being printed within a color object or in a black object that includes drops of process color within the object. In these circumstances, undesired image artifacts and halos are eliminated in images that include black portions that are adjacent color portions, and/or improved printed edges are created, by offsetting the corresponding black pixels relative to the color pixels and etching preselected pixels from the image before printing.

29 Claims, 9 Drawing Sheets

METHOD AND APPARATUS FOR PROCESSING IMAGES HAVING COLOR COMBINATIONS

BACKGROUND

This invention relates to a method and apparatus for processing images having color combinations. Such combinations may be embodied in, for example, a black object being printed within a color object or in a black object that includes drops of process color within the object. In these circumstances, undesired image artifacts and halos are eliminated in images that include black portions that are adjacent color portions, and/or improved printed edges are created, by offsetting the corresponding black pixels relative to the color pixels and etching preselected pixels from the image before printing.

While the invention is particularly directed to the art of image rendering, and will be thus described with specific reference thereto, it will be appreciated that the invention may have usefulness in other fields and applications. For example, the invention may be used in any image processing application where difficulties arise in the image at the border of different types or colors of pixels.

By way of background, a variety of difficulties arise when printing a color image, particularly where it is desired to print black objects among or within color portions of the image. As such, to print improved black colors, it has become desirable to print a black drop on top of a color drop. However, slight differences in alignment can have large effects on the amount of color that shows through. Moreover, printing drop on drop results in a color density on the printed page that could be improved. That is, portions of the page (i.e. between drops) can remain uncovered.

Therefore, when printing single large or multiple small ink drops to render a color image, it is advantageous to offset black drops from color drops by, for example, one-half pixel. This helps maintain color stability. That is, a better black color can be realized on the print medium.

A problem with offsetting alone, however, is that it may create undesired image characteristics and artifacts. In this regard, the printed image may include edges that are less than crisp or edges that are inconsistent from one side of the printed object to the other. Moreover, the image may experience inter-color bleed or asymmetric halos when printing color portions of the image adjacent black portions of the image.

The present invention contemplates a new and improved method and apparatus that resolve the above-referenced difficulties and others.

SUMMARY

A method and apparatus for processing images having color combinations are provided.

In one aspect of the invention, the method comprises determining which portions of the image are black, determining a process color to be printed based on the black portions, determining edges of the black portions of the image, reducing the process color by a predetermined amount along the edges based on a predetermined offset value, processing the image to obtain pixel values corresponding to drops of printing fluid to be emitted during printing of the image and emitting the drops such that black drops of the printing fluid are offset from process color drops based on the predetermined offset value to print the black portions of the image.

In another aspect of the invention, the method comprises steps of processing the image to obtain pixels corresponding to drops of printing fluid to be emitted during printing of the image, determining which pixels of the image correspond to the black portions of the image, identifying contiguous black pixels as a black object, determining a process color to be printed based on the black object, determining edges of the black object, reducing the process color by a predetermined amount along the edges based on a predetermined offset value and emitting the drops such that black drops of the printing fluid are offset from process color drops based on the predetermined offset value to print the black portions of the image In another aspect of the invention, the method comprises determining which portions of an image are black and which portions of an image are color, determining edges between the black portions and the color portions, reducing color by a predetermined amount along the edges based on a predetermined offset value, process of the image to obtain pixel values corresponding to drops of printing fluid to be emitted during printing of the image, and emitting the drops offset the black portions of the image are offset from the color portions based on the predetermined offset value.

In another aspect of the invention, the method comprises processing the image to obtain pixels corresponding to drops of printing fluid to be emitted during printing of the image, determining which pixels of the image correspond to the black portions of the image and which pixels correspond to the color portions of the image, identifying contiguous black pixels as a black object, determining edges of the black object, producing color by a predetermined amount along the edges based on a predetermined offset value, and emitting the drops such that the black object is offset from the color pixels based on the predetermined offset value.

In another aspect of the invention, a means for accomplishing the method is provided.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

DETAILED DESCRIPTION

Figure 1:
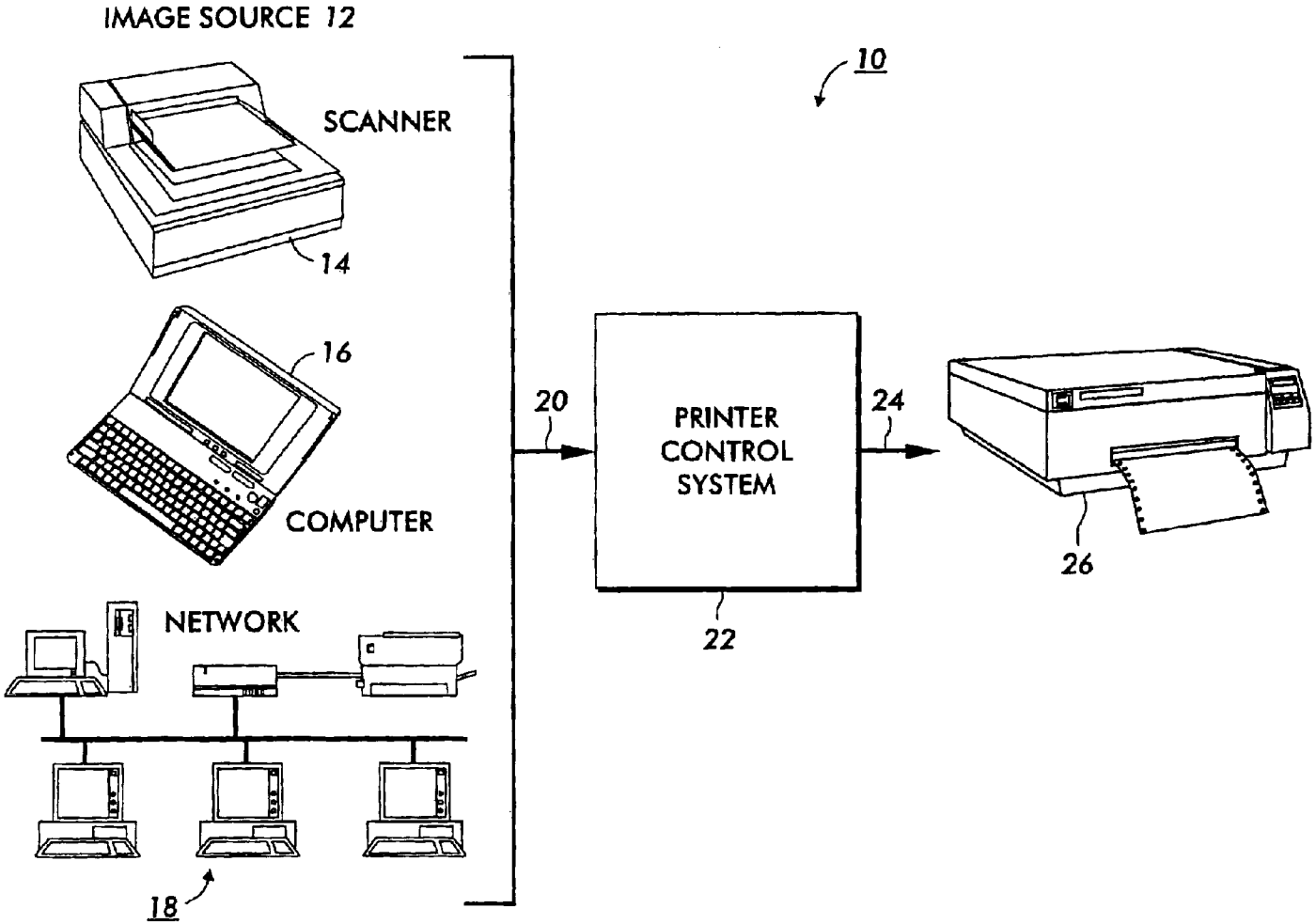
FIG. 1 is an illustration of a system into which the present invention may be incorporated.

Referring now to the drawings wherein the showings are for purposes of illustrating the preferred embodiments of the invention only and not for purposes of limiting same, FIG. 1 provides a view of an overall exemplary system incorporating the features of the present invention. As shown, an exemplary printing system 10 includes image source 12. The source 12 may include scanner 14, computer 16, network 18 or any similar or equivalent image input terminal providing image data 20—which may be any combination of ASCII data, bitmapped image, geometric data, graphics primitives, fonts, page description language, etc.

Image data 20 is supplied to printer control system 22 which processes the received image data 20 to produce print data 24 that drives printer 26. Printer control system 22 may comprise what is commonly referred to in the art as a print driver. Those skilled in the art will recognize that control system 22 may be implemented in hardware and/or software and may reside within in image source 12, within printer 26, within a separate component or in any combination thereof. In response to print data 24, which may comprise image data and/or printer control signals (e.g., paper handling, carriage control, ink deposition), printer 26 generates an output image on a suitable print medium. Beneficially, printer 26 may comprise an ink jet printer.

Figure 2:
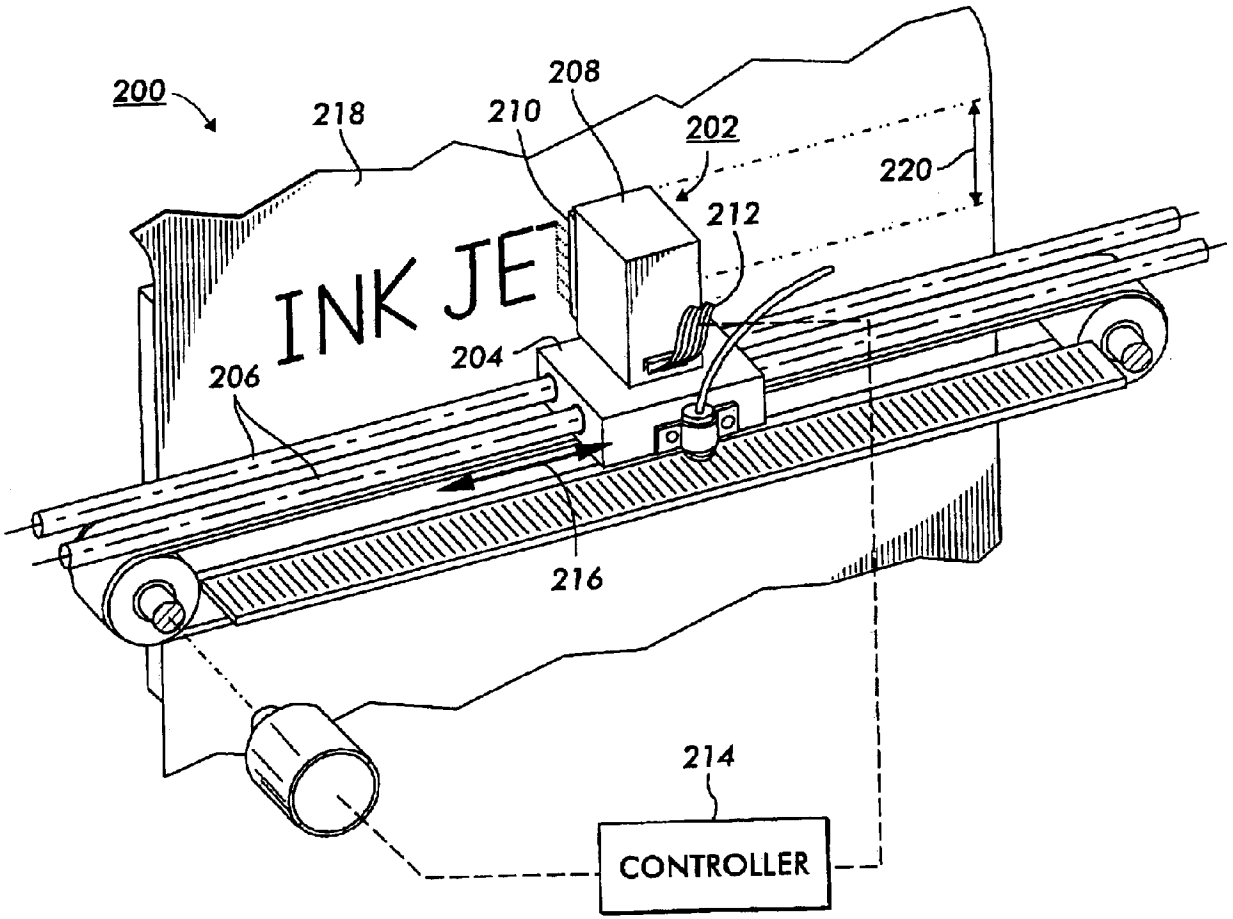
FIG. 2 is an ink jet printer system into which the present invention may be incorporated.

Turning now to FIG. 2, there is shown a partial schematic perspective view of an ink jet printer 200 suitable for use in the system of FIG. 1. Printer 200 includes an ink jet printhead cartridge 202 mounted on carriage 204 supported by carriage rails 206. The printhead cartridge 202 includes housing 208 containing ink for supply to printhead 210 which selectively expels droplets of ink in response to control signals received from controller 214 through a communication cable 212. Printhead 210 contains a plurality of ink conduits or channels (not shown) which carry ink from housing 208 to respective ink ejectors, which eject ink through orifices or nozzles (also not shown). To effectuate printing, controller 214 is coupled to one or more printhead control circuits (not shown). The printhead control circuits receive information from controller 214 via control signals received through communication cable 212. In accordance with the content of the signals received, the control circuits provide for selected ejection of inks from the nozzles of printhead 210.

When printing, carriage 204 reciprocates or scans back and forth along carriage rails 206 in the directions of arrow 216. As the printhead cartridge 202 reciprocates back and forth across a recording medium 218, such as a sheet of paper or transparency, droplets of ink are expelled from selected ones of the printhead nozzles towards the recording medium. During each pass of carriage 204, the recording medium 218 is held in a stationary position. Upon the completion of one or more passes, the recording medium is advanced in the direction of arrow 220 by a feed mechanism under control of controller 214.

Although an ink jet system is described as an environment into which the present invention may be incorporated, other systems may likewise benefit from the invention. For example, the invention will find application in acoustic ink printing applications, as well as piezoelectric printing applications. It will be appreciated that the invention may be implemented in any system that prints drops of a liquid on a medium. Of course, it should further be appreciated that modifications to alternative systems may be necessary to account for differences in these different printing environments. For example, the fact that acoustic ink printers typically print multiple drops per pixel should be recognized in any incorporation of the present invention in such a system.

The present invention is directed toward aspects of the printer control system 22 depicted in FIG. 1 and/or the corresponding controller 214 of FIG. 2. In particular, the present invention is directed to an apparatus and method for processing images having adjacent color and black portions and/or black portions printed with process color portions. As referenced above, a variety of difficulties arise when printing in such an environment. To fully appreciate and understand the present invention, it will be beneficial to refer to the examples of FIGS. 3(*a*), 3(*b*), 4(*a*), 4(*b*), 5(*a*) and 5(*b*).

Figure 3A:
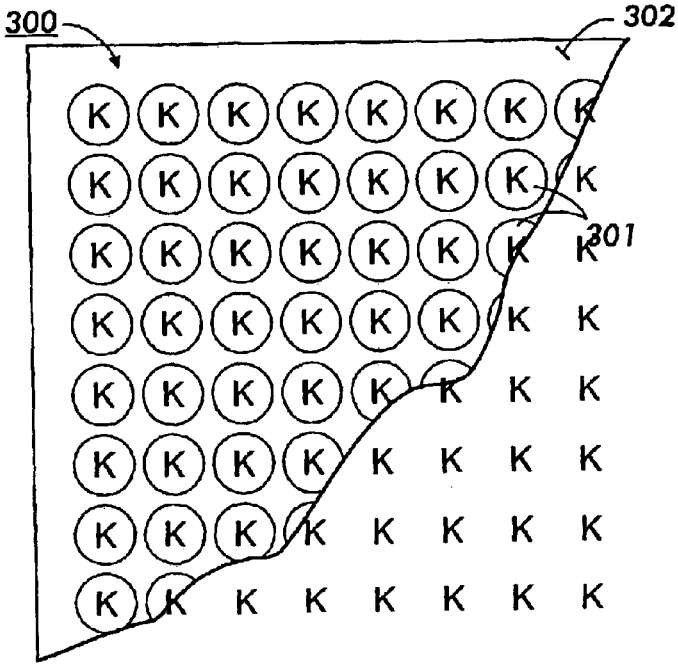
FIGS. 3(*a*) and (*b*) illustrate a process of offsetting process colors from black.
Figure 3B:
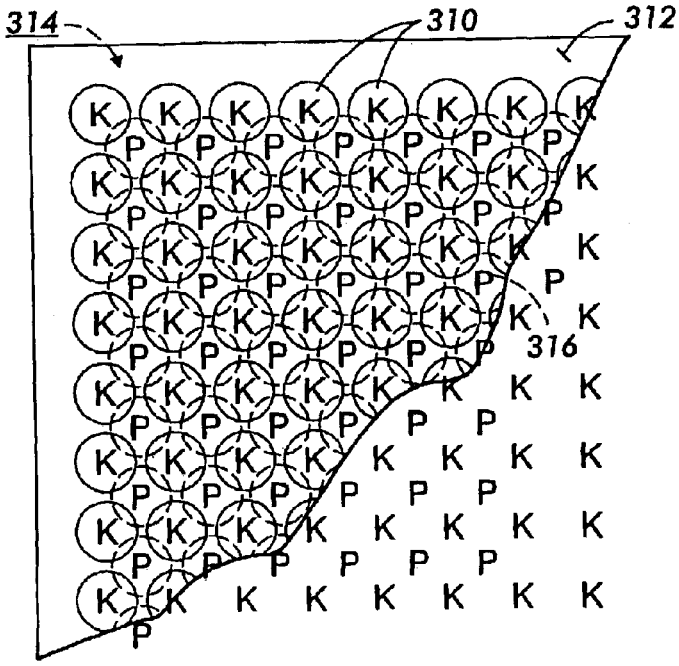

In FIG. 3(*a*), an array 300 of printed black pixels (K), such as that shown at 301, disposed on a page 302 is shown. Note that these black pixels do not cover the entire page. That is, space is interspersed between the pixels. This may be due to the small size of the black drops, as shown in the figure, or it may be in part due to small errors in drop position. To cover the entire page in that which is perceived as solid black, it has been found that use of a neutral color (e.g., combination of cyan, magenta and yellow (CMY)) such as gray can be offset and, thus, printed between and overlapping with the black (K) pixels to cover the white space. The neutral color is referred to as a process color. This approach results in a solid black color being perceived to a viewer. With reference to FIG. 3(*b*), printed black pixels (K), such as that shown at 310, disposed on a page 312 in an array 314 are shown. White spaces between the black pixels, however, are covered with neutral color pixels (P) referenced above. That is, neutral colored pixels, such as that shown at 316, are offset from the black pixels to create that which is perceived by the viewer as solid black. In essence, offsetting process color pixels (P) from the black pixels (K) provides a better printed black. This can be done by using an image at the resolution of one of the colors or it could be done by using a higher resolution image and only printing a portion of the pixels, the black and colors printed from different pixels offset from each other.

Figure 4A:
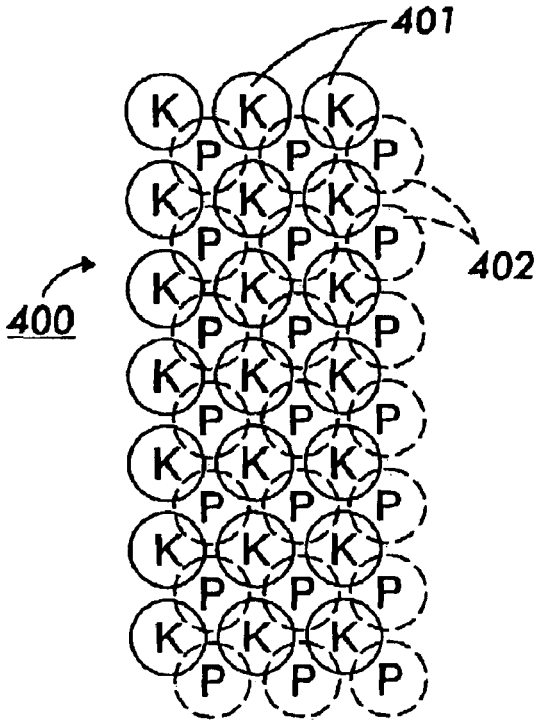
FIGS. 4(*a*) and (*b*) illustrate features of the present invention.
Figure 4B:
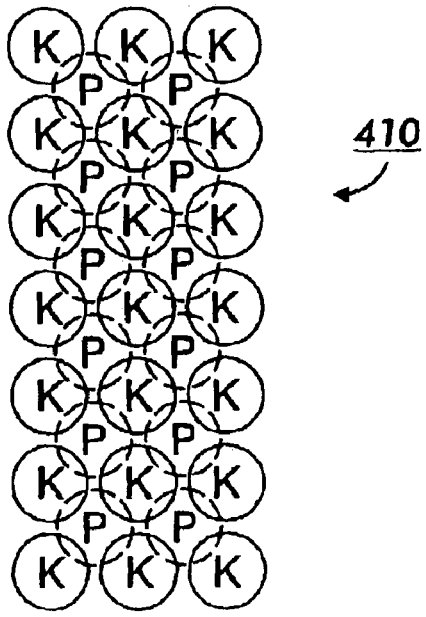

As noted above, however, simply offsetting the process color from the black does not necessarily result in a preferred image quality. To illustrate, a lower case "L" printed using the offset technique is shown in FIG. 4(*a*). In the illustrated character 400, black pixels (K) are shown as being offset from the process color pixels (P). The black pixels (K) are offset toward the left and top of the page, as shown. It should be appreciated that offset is a relative term, so use of the term herein is intended to cover situations where black pixels are offset relative to color pixels and where color pixels are offset relative to black pixels. Though the figure shows the colors offset by half a pixel in two dimensions other offset amounts which differ in each dimension are possible.

Inconsistency in the edges of the character 400 is apparent. In particular, certain edges are defined by crisp black dots of ink while other edges have process color mixed therein. As shown in FIG. 4(*a*), black pixels (K), such as that shown at 401, border the top and left side of the character 400 while process color pixels (P), such as that designated at 402, border the right and bottom sides of the character 400.

To improve the quality of the edges, the present invention is directed, in at least one embodiment, to the further steps of removing the process pixels on the edges of the object in a direction that is opposite the offset direction of the black pixels. In FIG. 4(*b*), a small letter L (character 410), that results from implementation of the present invention, is illustrated. That is, the color pixels (P) along the edges toward the right and bottom side of the character 400 (FIG. 4(*a*)) are removed to obtain the character 410 of FIG. 4(*b*). Specifically, crisp black edges border the entire character, as opposed to having a process color edge border select parts of the character.

Figure 5A:
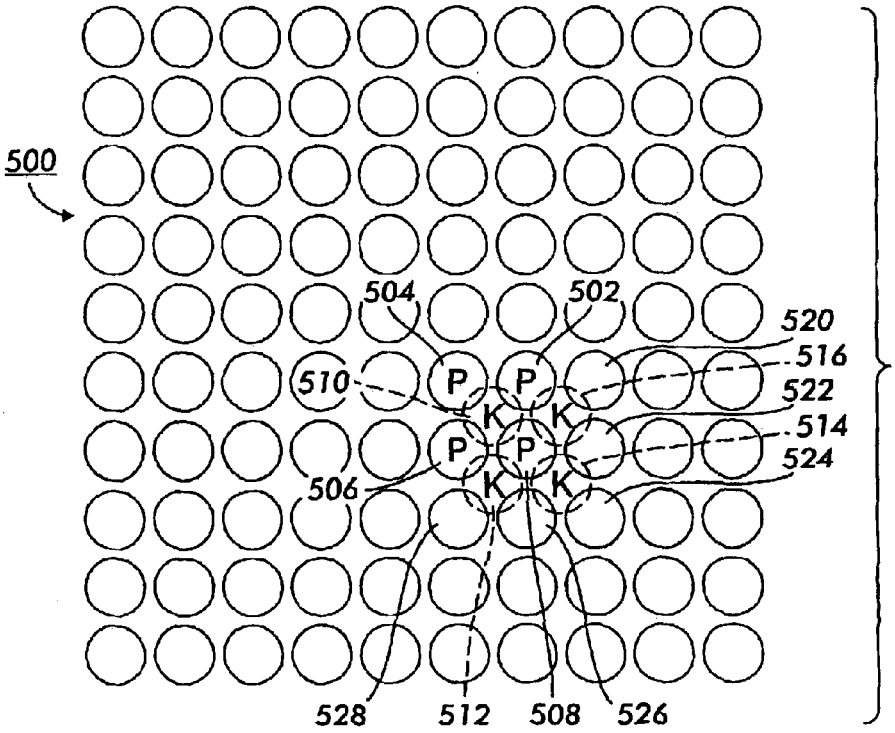
FIGS. 5(*a*) and (*b*) illustrate features of the present invention.
Figure 5B:
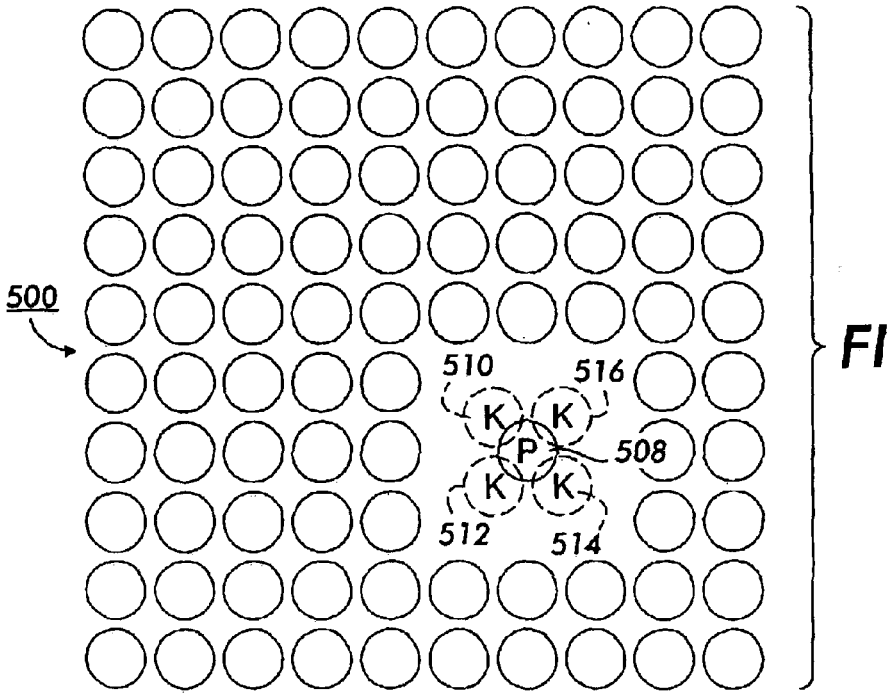

Referring now to FIGS. 5 (*a*) and (*b*), the present invention may be used in printing a black object within color portions of an image. As with the teachings in connection with FIGS. 4 (*a*) and (*b*), an offset technique is used to address the difficulties of printing a black object within a color field. However, simply offsetting the color from the black does not necessarily result in a preferred image quality. As such, an offset along with the removal of color is used in the present invention to improve the quality of printing.

In FIG. 5 (*a*), an array 500 of pixels or drops is shown. The array comprises process color pixels 502, 504, 506, and 508, which are also designated with a P. Unmarked image color pixels, such as those numbered 520, 522, 524, 526, and 528, represent drops of color that are different from the process color pixels. That is, the image color pixels may be cyan, while the process color pixels are primarily gray to accommodate the printing of a better black. Black pixels 510, 512, 514, and 516 are offset to the bottom and right of the page relative to the process color pixels 502, 504, 506, and 508. Thus, the black object within the color field of cyan comprises the process color pixels 502, 504, 506, and 508 and the black pixels 510, 512, 514, and 516. As is apparent, however, the black object is not of desirable quality. For example, it has edges that are not crisp due to the presence of the process color pixels 502, 504, and 506 on the top and left edges of the object. Further, the black pixels 512, 514, and 516 on the bottom and right edges of the object are overlapped onto the cyan pixels 520, 522, 524, 526, and 528. This is known as inter-color bleed and, in these circumstances, creates image artifacts that are not desired. Of course, the edges also lack consistency relative to one another.

Therefore, as shown in FIG. 5 (*b*) and in accord with the present invention, the process color pixels 502, 504, and 506 (in a direction opposite the offset of the black pixels relative to the process color pixels, i.e. toward the top and left of the page) are removed. Conversely, the image color pixels 520, 522, 524, 536, and 528 (in the direction of the offset of the black pixels relative to the process color pixels, i.e. toward the right and bottom of the page) are removed. This results in a black object being printed within the color field as shown that has crisp black edges but does not overlap into the color field of cyan.

The description in connection with FIGS. 1 through 5(*b*) illustrates the features and functions of the present invention as well as a general printing environment for its use. It should be appreciated, however, that the invention may be implemented in a variety of manners as a function of the precise environment into which it is incorporated. For example, the invention may be embodied in software that is utilized by the printer control system 22 or the print controller 214—which may be in, for example, the printer or a print driver of a suitable host computer. Likewise, the invention may take the form of a suitable software and hardware combination that achieves the understood objectives.

While the invention has been described for an offset of black relative to all the other colors, it could be that a number of the primary colors have different offsets. Thus, the removed drops of a particular primary color would depend on the offset for that color. For example, if one of the primary colors is offset from black in only one dimension and another is offset in two dimensions, the eliminated drops of the first color would only occur along the one-dimensional axis while the drops eliminated for the second would occur in two dimensions. Furthermore, with different primary colors having different offsets, it would be desirable that combinations of two such colors (combination colors) also have one or other of the colors removed at their edges. As such, methods described herein could be adopted to account for these circumstances. For example, the methods could be adopted to account for primary colors having color reductions at edges as opposed to black and color portions having color reductions at edges.

The precise implementation of the methods of the present invention in a corresponding system may well depend on the point in the printing process that certain steps are implemented. For example, the method that is implemented may depend on whether particular steps of the invention are utilized before or after the image is digitized, rasterized, half-toned, or subjected to error diffusion. Also, the methods may be selectively used for different types of objects. For example it may be used for printing graphics and text, while images are either left alone or processed with different parameters.

Light neutral objects may be printed with cyan, magenta, yellow, and no black, so there would be no need for etching or reducing color according to the present invention. But, as objects contain more black, especially with more color ink used in addition or used for neighboring objects, it may be beneficial to reduce the amount of ink for some pixels. It is important to provide a smooth transition from non-etched to etched behavior since some objects will contain gray sweeps from light to dark. Also, some objects of nearly equal colors may appear within the same image. To this end, we define a drop transition function E(K), depending on the input K value that has values from 0 to 1. A value for this of 0 means input image is unchanged and 1 means the value for the color is completely removed as described in previous examples. For outputs in-between 0 and 1, the color is reduced but not eliminated. If this step occurs before rendering, then the color values in the image are simply reduced by the fraction E(K). If it is done after rendering, then drops are removed with a probability E(K) either in a predetermined pattern, an adaptive pattern, or by a random process and where K is determined by the number of black drops printed in the immediate vicinity. There will be some initial $K_0$ at which the values begin to be reduced and another $K_{max}$ at which the etching reaches 1. The simple linear form for E(K) is adequate in most cases.

Figure 6:
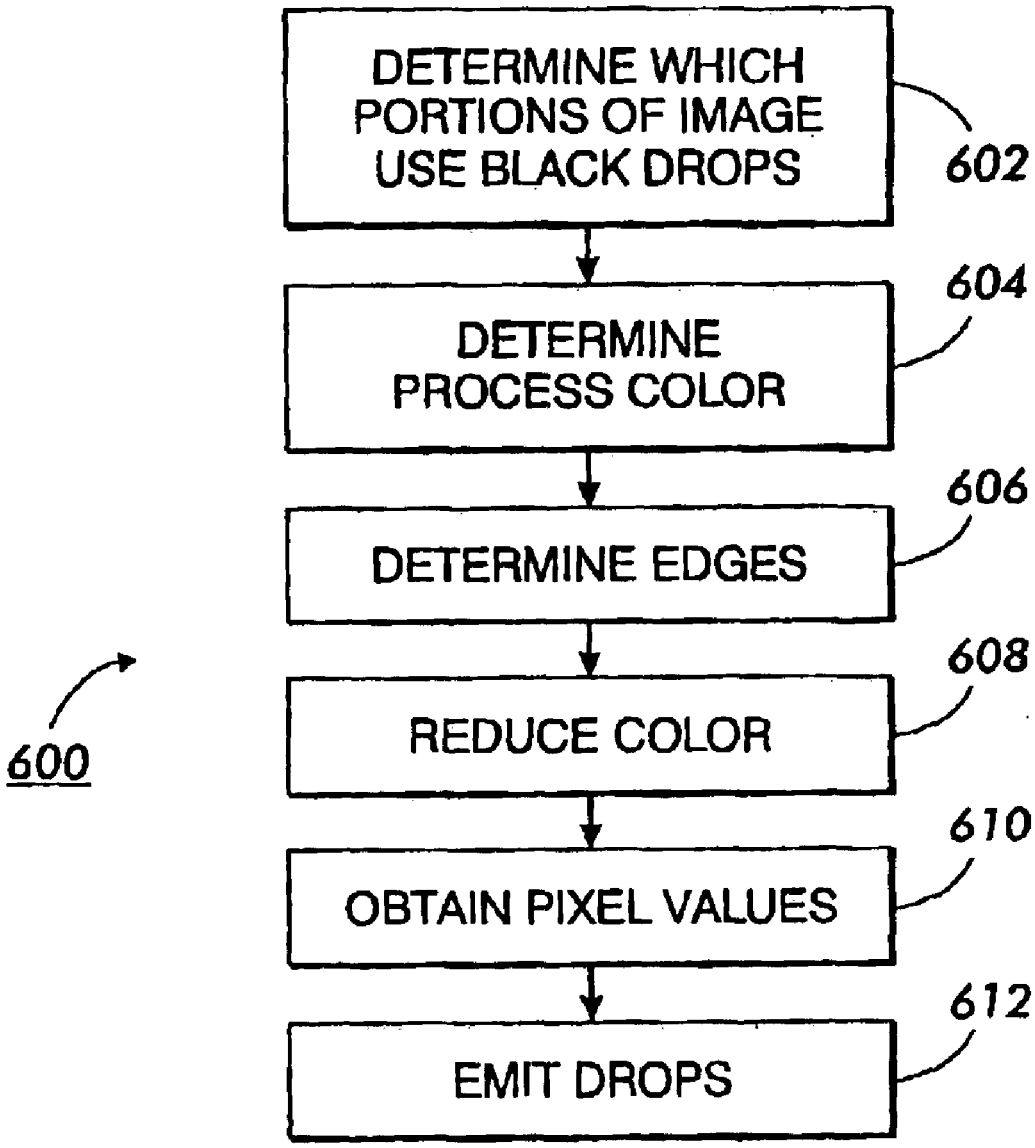
FIG. 6 is a flow chart illustrating a method according to the present invention.
Figure 7:
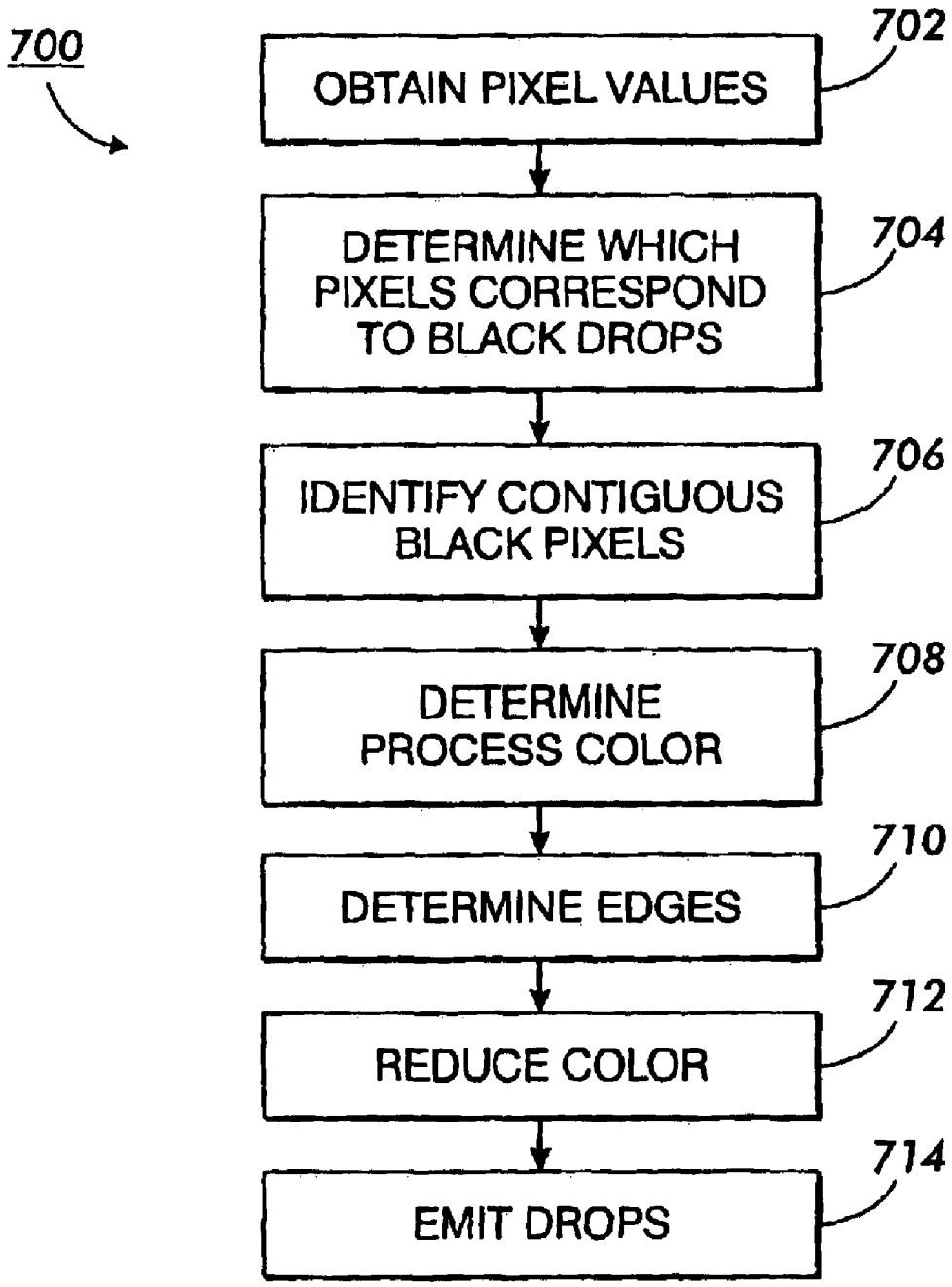
FIG. 7 is a flow chart illustrating a method according to the present invention.

Referring now to FIGS. 6 and 7, methods according to the present invention are more specifically described. These methods are most advantageously applied to address the circumstances identified in FIGS. 4(*a*) and (*b*). That is, these methods allow for the printing of an improved black color when, for example, a character is being printed. It should be recognized that such methods are adaptable to address the circumstances of FIGS. 5 (*a*) and (*b*); however, for simplicity, the method for addressing difficulties with printing black adjacent color will be described separately in connection with FIGS. 8 and 9.

FIG. 6 illustrates a method wherein selected steps are accomplished prior to the digitizing of the image. As shown, a method 600 comprises initially determining which portions of the image use black drops (step 602). Of course, this may entail determining which portions of the image are black. However, it may also include determining which portions, while not predominantly black per se, use black drops, such as gray portions or dark color portions. Next, a determination is made as to a process color to be printed based on the use of black as determined above (step 604). The edges of the portions of the image using black drops are then determined (step 606). The process color is then reduced by a predetermined amount along the edges based on an offset value and the process color (step 608). It should be appreciated that color is preferably reduced on some but not all (i.e. selected) sides of the relevant portion consistent with the direction of the ultimate offset of the drops. This is illustrated in FIGS. 4(*a*) and 4(*b*), for example. As shown, the reduction of process color occurs on sides that lie in a direction opposite the offset direction of the black drops from the color drops. Further, as noted above in connection with the drop transition function E(K), the reduction may not necessarily result in an elimination of color, only a reduction. The offset value is calculated or determined, in one embodiment, based on predetermined criteria. The predetermined criteria may comprise at least one of nozzle alignment, nozzle spacing, and timing of emission of the drops from a printhead. It should be appreciated that the offset value may vary depending on the precise environment of implementation;, an offset value of approximately one-quarter to one-halfthe size of a drop, or a group of multiple small drops, will usually suffice. The image is then processed to obtain pixel values corresponding to drops of printing fluid to be emitted during printing of the image (step 610). This processing may include any known techniques for digitizing an image such as rasterizing, half-toning or error diffusion. The drops are then emitted such that black drops of the printing fluid are offset from process color drops based on the offset value to print the portions of the image using black drops (step 612).

Referring now to FIG. 7, a similar method is illustrated; however, in this method selected steps are performed after the digitizing of the image. As shown, the method 700 includes processing the image to obtain pixels corresponding to drops of printing fluid to be emitted during printing of the image (step 702). This processing may include any known techniques for digitizing an image such as rasterizing, half-toning or error diffusion. A determination is then made as to which pixels of the image correspond to the portions of the image using black drops (step 704). Of course, this may entail determining which portions of the image are black. However, it may also include determining which portions, while not predominantly black per se, use black drops, such as gray portions or dark color portions. Contiguous black pixels covering some predetermined distance or area are then identified as a black object and portions or objects having significantly more black pixels than adjacent portions are likewise identified (step 706). Identification of such portions may be accomplished by use of a suitable segmentation process or page description language. A process color to be printed is then determined based on these portions (step 708). The edges of the black object or portion of the image using black drops are then determined (step 710). The process color is then reduced by a predetermined amount along the edges based on an offset value (step 712). It should be appreciated that color is preferably reduced on some but not all (i.e. selected) sides of the relevant portion consistent with the direction of the ultimate offset of the drops. This is illustrated in FIGS. 4(*a*) and 4(*b*), for example. As shown, the reduction of process color occurs on sides that lie in a direction opposite the offset direction of the black drops from the color drops. Further, as noted above in connection with the drop transition function E(K), the reduction may not necessarily result on an elimination of color, only a reduction. The offset value is calculated, in one embodiment, based on predetermined criteria. The predetermined criteria may comprise at least one of nozzle alignment, nozzle spacing, and timing of emission of the drops from a printhead. It should be appreciated that the offset value may vary depending on the precise environment of implementation; however, an offset value of approximately one-quarter to one-half the size of a drop will usually suffice. Last, the drops are emitted such that black drops of the printing fluid are offset from process color drops based on the predetermined offset value to print the black portions of the image (step 714).

Figure 8:
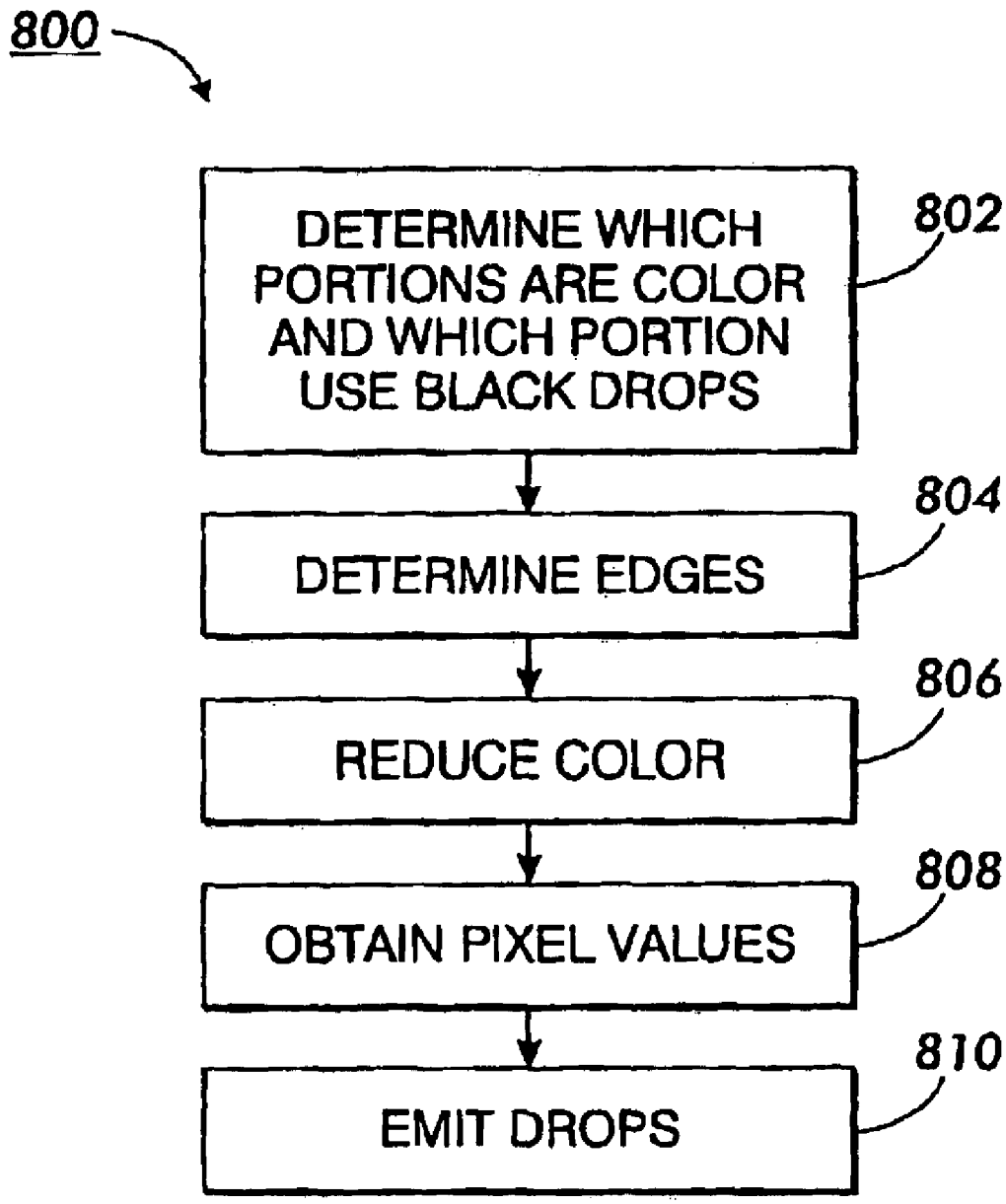
FIG. 8 is a flow chart illustrating a method according to the present invention; and, FIG. 9 is a flow chart illustrating a method according to the present invention.

FIG. 8 illustrates a method for addressing the circumstances described in connection with FIGS. 5 (*a*) and (*b*) where selected steps are performed prior to digitizing the image. More particularly, the method 800 comprises determining which portions of the image use a significant amount of black drops (e.g. black, gray or dark color portions) and which portions of the image are color (but do not use significant amounts of black) (step 802). The edges between predominantly black portions and such color portions of the image are then determined (step 804). Color is then reduced by a predetermined amount along the edges based on an offset value (step 806). It should be appreciated that color is preferably reduced on some but not necessarily all of the edges. As would be the case with the example shown in FIGS. 5(*a*) and 5(*b*), the reduction of color preferably occurs along the edges in the direction of the offset. Further, as noted above in connection with the drop transition function E(K), the reduction may not necessarily result in an elimination of color, only a reduction. The offset value is calculated, in one embodiment, based on predetermined criteria. The predetermined criteria may comprise at least one of nozzle alignment, nozzle spacing, and timing of emission of the drops from a printhead. It should be appreciated that the offset value may vary depending on the precise environment of implementation; however, an offset value of approximately one-quarter to one-half the size of a drop will usually suffice. The image is then processed to obtain pixel values corresponding to drops of printing fluid to be emitted during printing of the image (step 808). This processing may include any known techniques for digitizing an image such as rasterizing, half-toning or error diffusion. Moreover, this processing may include obtaining pixel values corresponding to the identified color portions, the predominantly black portions and process color portions. The process color portions correspond to the black portions such that a process color and black is emitted to render the black portions of the image. Last, the drops are emitted such that the predominantly black portions of the image are offset from the color portions based on the predetermined offset value (step 810).

Figure 9:
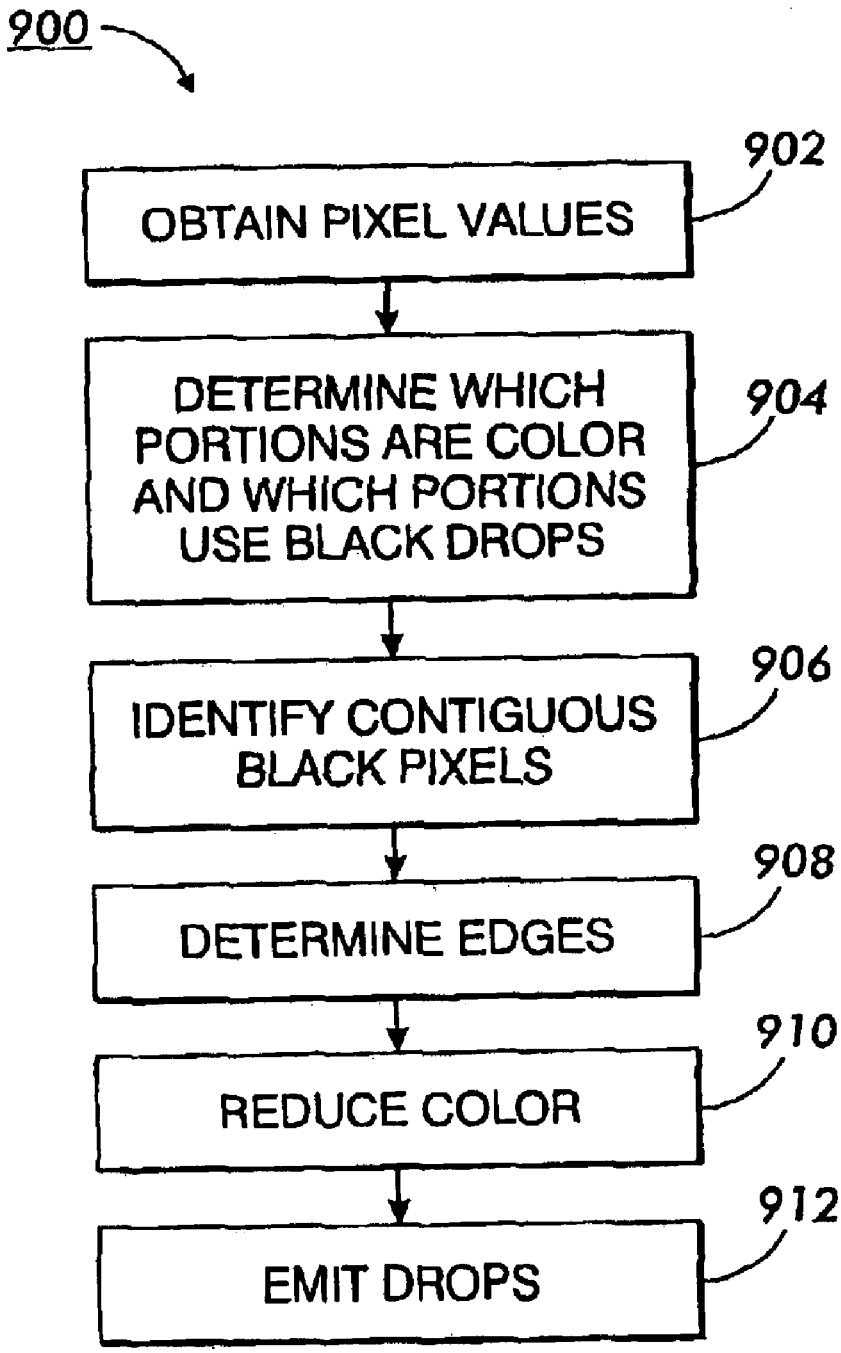

Referring now to FIG. 9, an alternative method 900 to that described in connection with FIG. 8 is set forth. The method recognizes that certain steps may occur after the image is digitized and, thus, includes initially processing the image to obtain pixels corresponding to drops of printing fluid to be emitted during printing of the image (step 902). This processing may include any known techniques for digitizing an image such as rasterizing, half-toning or error diffusion. Moreover, this processing may include obtaining pixel values corresponding to the color portions (not containing significant black pixels), the predominantly black portions (e.g. black, gray or dark color portions) and process color portions. The process color portions correspond to the black portions such that a process color and black is emitted to render the black portions of the image. A determination is then made as to which pixels of the image correspond to the predominantly black portions of the image and which pixels correspond to the color portions of the image (step 904). Contiguous black pixels covering some predetermined distance or area are then identified as a black object and portions or objects having significantly more black pixels than adjacent portions are likewise identified (step 906). Identification of the objects may be accomplished by use of a suitable segmentation process or page description language. Edges of such objects are then determined (step 908). The color is then reduced by a predetermined amount along the edges based on a predetermined offset value (step 910). It should be appreciated that color is preferably reduced on some but not necessarily all of the edges. As would be the case with the example shown in FIGS. 5(*a*) and 5(*b*), the reduction of color preferably occurs along the edges in the direction of the offset. Further, as noted above in connection with the drop transition function E(K), the reduction may not necessarily result in an elimination of color, only a reduction. The offset value is calculated, in one embodiment, based on predetermined criteria. The predetermined criteria may comprise at least one of nozzle alignment, nozzle spacing, and timing of emission of the drops from a printhead. It should be appreciated that the offset value may vary depending on the precise environment of implementation; however, an offset value of approximately one-quarter to one-half the size of a drop will usually suffice. Last, the drops are emitted such that the black object is offset from the color pixels based on the predetermined offset value (step 912).

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

I claim:

1. A method for processing an image to be printed on a page, the image having portions of a combination color comprising primary colors, the method comprising steps of:

determining which portions of the image use the combination color;

determining edges of the portions of the image;

reducing the primary colors by an amount along selected edges based on an offset value and the combination color;

processing the image to obtain pixel values corresponding to drops of printing fluid to be emitted during printing of the image; and, emitting the drops such that drops of the printing fluid of one of the primary colors is offset from drops of another primary color based on the offset value to print the portions of the image.

2. The method as set forth in claim 1 further comprising calculating the amount each color is reduced.

3. The method as set forth in claim 2 wherein the calculating is based on predetermined criteria.

4. The method as set forth in claim 3 wherein the predetermined criteria comprise at least one of nozzle alignment, nozzle spacing, and timing of emission of the drops from a printhead.

5. The method as set forth in claim 1 wherein the determining of which portions of the image use the combination color includes identifying objects.

6. The method as set forth in claim 5 wherein the identifying is based on a page description language.

7. The method as set forth in claim 5 wherein the identifying is based on a segmentation of the image.

8. The method as set forth in claim 1 where the combination color contains black.

9. A method for processing an input image to be printed on a page, the image having portions of black, the method comprising steps of:

determining process color and black to be printed based on the input image;

processing the image to obtain pixels corresponding to drops of printing fluid to be emitted during printing of the image;

identifying contiguous black pixels as a black object;

determining edges of the black object;

reducing the process color by amounts along selected edges based on offset values; and, emitting the drops such that black drops of the printing fluid are offset from process color drops based on the offset values to print portions of the image.

10. The method as set forth in claim 9 further comprising calculating the offset values.

11. The method as set forth in claim 10 wherein the calculating is based on predetermined criteria.

12. The method as set forth in claim 11 wherein the predetermined criteria comprise at least one of nozzle alignment, nozzle spacing, and timing of emission of the drops from a printhead.

13. A method for processing an image to be printed on a page, the image having first portions of significant amounts of black adjacent second portions of color having less black or no black amounts, the method comprising steps of:

determining which portions of the image are first portions and which portions of the image are second portions;

determining edges between the first portions and the second portions of the image;

reducing color by amounts along the edges based on offset values;

processing the image to obtain pixel values corresponding to drops of printing fluid to be emitted during printing of the image; and, emitting the drops such that the drops are offset from each other based on the offset values.

14. The method as set forth in claim 13 further comprising calculating an amount each color is reduced.

15. The method as set forth in claim 14 wherein the calculating is based on predetermined criteria.

16. The method as set forth in claim 15 wherein the predetermined criteria comprise at least one of nozzle alignment, nozzle spacing, and timing of emission of the drops from a printhead.

17. The method as set forth in claim 13 wherein the determining of which portions of the image are first portions and which portions of the image are second portions includes identifying objects.

18. The method as set forth in claim 17 wherein the identifying is based on a page description language.

19. The method as set forth in claim 17 wherein the identifying is based on a segmentation of the image.

20. The method as set forth in claim 13 wherein the processing includes obtaining pixel values corresponding to the second portions, the first portions and process color portions, the process color portions corresponding to the first portions such that at least a process color and black is emitted to render the first portions.

21. The method as set forth in claim 20 wherein the emitting is accomplished such that the first portions of the image are also offset from the process color portions based on the offset value.

22. A method for processing an image to be printed on a page, the image having first portions of significant amounts of black adjacent second portions of color having less or no black amounts, the method comprising steps of:

processing the image to obtain pixels corresponding to drops of printing fluid to be emitted during printing of the image;

determining which pixels of the image correspond to the first portions of the image and which pixels correspond to the second portions of the image;

identifying contiguous black pixels as a black object;

identifying other objects;

determining edges of the black and other objects, reducing colors by amounts along the edges based on offset values; and, emitting the drops such that black drops are offset from color drops based on the offset values.

23. The method as set forth in claim 22 further comprising calculating the offset values.

24. The method as set forth in claim 23 wherein the calculating is based on predetermined criteria.

25. The method as set forth in claim 24 wherein the predetermined criteria comprise at least one of nozzle alignment, nozzle spacing, and timing of emission of the drops from a printhead.

26. The method as set forth in claim 22 wherein the processing includes obtaining pixels corresponding to the second portions, the first portions and process color portions, the process color portions corresponding to the first portions such that at least a process color and black is emitted to render the first portions.

27. The method as set forth in claim 26 wherein the emitting is accomplished such that the object is also offset from process color pixels based on the predetermined offset values.

28. A system for processing an image to be printed on a page, the image having portions of black, the system comprising:

means for determining which portions of the image incorporate black and are to be printed using a process color;

means for determining edges of the portions;

means for reducing the process color by an amount along the edges based on an offset value;

means for processing the image to obtain pixel values corresponding to drops of printing fluid to be emitted during printing of the image; and, means for emitting the drops such that black drops of the printing fluid are offset from process color drops based on the offset value to print the portions of the image.

29. A system for processing an image to be printed on a page, the image having first portions of significant amounts of black adjacent second portions of color having no black or less black amounts, the system comprising:

means for processing the image to obtain pixels corresponding to drops of printing fluid to be emitted during printing of the image;

means for determining which pixels of the image correspond to the first portions of the image and which pixels correspond to the second portions of the image;

means for determining edges of the first portions;

means for reducing color by an amount along the edges based on an offset value; and, means for emitting the drops such that black drops are offset from color drops based on the offset value.

* * * * *